US006123278A

United States Patent [19]

Chaplenko

[11] Patent Number: 6,123,278

[45] Date of Patent: Sep. 26, 2000

[54] GRINDING MILL

[75] Inventor: George Chaplenko, Edison, N.J.

[73] Assignee: Metuchen Inc., Metuchen, N.J.

[21] Appl. No.: 09/266,784

[22] Filed: Mar. 12, 1999

[51] Int. Cl.[7] ..... B02C 19/00

[52] U.S. Cl. ..... 241/30; 241/199.1; 241/206; 241/228

[58] Field of Search ..... 241/228, 206, 241/207, 30, 26, 27, 199.7, 199.1

[56] References Cited

U.S. PATENT DOCUMENTS

| | | | |
|---|---|---|---|
| 10,567 | 2/1854 | Eaton | 241/206 |
| 533,478 | 2/1895 | Lovett | 241/206 |
| 4,905,920 | 3/1990 | Siwersson et al. | 241/207 |

OTHER PUBLICATIONS

Angstrom, Inc., "Laboratory Ring Pulverizers".
Podmore Gy–ro Laboratory Grinding Mill & Podmore Sample Grinding Barrels.
Herzog Japan Ltd., "Herzog Pulverizing Mills".
TM Engineering Ltd., "TM/S Pulverizer".
Classic Comlabs Ltd, "Mixermill 4010".
Applied Research Laboratories, "Rotary Mill for Sample Preparation".
GyralGrinder, "Chemplex Industries, Inc", 1994.
Rocklabs, Ltd., "Rocklabs Whisper Series Bench Top Ring Mill", Apr. 1996.
Labtech LM5 Mill, "Lab Technics", Oct., 1998.

*Primary Examiner*—Mark Rosenbaum
*Attorney, Agent, or Firm*—Fish & Neave; Jeffrey H. Ingerman; Joel Weiss

[57] ABSTRACT

A grinding mill is provided. The mill uses a substantially two-dimensional system for producing gyratory motion in a dish for the purpose of rotating a puck within the dish. The system includes a spin-disk having a circular off-center cavity for holding a dish holder fixedly containing a dish. When the spin-disk is rotated, the dish holder orbits about a point other than its center point, but does not rotate about its center point because its movement is limited by a restrainer. A puck is disposed within the dish, possibly along with a ring, in a fashion that allows the puck, and the ring if present, to freely move within the dish. Thus, the dish holder orbits but does not rotate and the puck spins or bounces within the dish. The combination of these movements causes the puck to impact the dish in a way that crushes a sample within the dish. The mill may be constructed small enough to be used on a work bench. It can also be completely enclosed in a carrying case for efficient transport and storage.

12 Claims, 3 Drawing Sheets

GRINDING MILL

BACKGROUND OF THE INVENTION

This invention relates to grinding mills. Grinding mills are used for pulverizing materials or mixing them to prepare them for analysis. Typically, grinding mills grind cement mix, rocks, slags, soils, ceramics, and ores. They have also been used for hundreds of other materials including sulfur pellets, dried marsh-grass, pharmaceuticals, and other materials which are reasonably brittle or are rendered brittle by some suitable means, such as cryogenic cooling.

More particularly, the present invention relates to swing mills. Swing mills generate motion in an orbital fashion and cause an element to move within a container, thereby grinding the contents of the container. Conventional swing mills, such as those sold by the assignee under the trade name SHATTERBOX®, swing a dish-shaped grinding container in a tight, high-speed circle. Inside the dish are the sample to be ground, a puck, and (in larger containers) a ring. Grinding in the swing mill is performed by imparting different motions to the dish and puck or ring (hereinafter, any references to puck should be understood to include, under suitable circumstances, a ring or rings or other hard objects, such as various sized balls, which can move freely within a container). The dish is caused to orbit about some point other than its center point and the puck is allowed to move freely within the dish. As these grinding elements swing free inside the dish, the sample is rapidly crushed between the walls of the dish and the grinding elements, and further attrited by the millstone-like action of the puck against the container floor (thus the name "swing mill").

The main issue in swing mill design is causing the dish to orbit around some point other than its own center point without rotating the dish around its own center point. Causing rotation of an object around its own center point is not difficult because a conventional motor can provide rotational force. However, causing an object to orbit without rotating presents a more complex design problem. This type of action is required to create the grinding motion of the puck within the dish. The present invention addresses this design problem.

Generally, conventional swing mills that create the above-mentioned motion are large, immobile pieces of laboratory machinery. A small swing mill that can be used on a bench-top is especially advantageous because it affords easy access to the swing mill, provides transportability of the swing mill for fieldwork, saves space in the laboratory and allows the user to move the swing-mill around within the laboratory.

Therefore, it would be desirable to provide a grinding mill that utilizes a simple and cost-effective mechanism to grind a sample.

It would also be desirable to provide a mill that is relatively light and occupies a small area of space so that the mill can be easily transported.

It would also be desirable to provide a mill that is relatively short so that the mill can be easily loaded and unloaded in a bench-top environment.

SUMMARY OF THE INVENTION

It is an object of this invention to provide a grinding mill that utilizes a simple and cost-effective mechanism to grind a sample.

It is an object of this invention to provide a mill that is relatively light and occupies a small area of space so that the mill can be easily transported.

It is an additional object of this invention to provide a mill that is relatively short so that the mill can be easily loaded and unloaded in a bench-top environment.

The mill according to the principles of the invention includes a dish, a dish holder, a spin-disk having an off-center cavity for holding the dish holder, a restrainer attached to the dish holder for restraining the dish from rotating about its own axis, a coupler preferably comprising a pair of rollers for engaging the restrainer, a puck disposed within the dish for grinding the sample, a base, and a motor for rotating the spin-disk at a speed sufficient to grind the sample.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
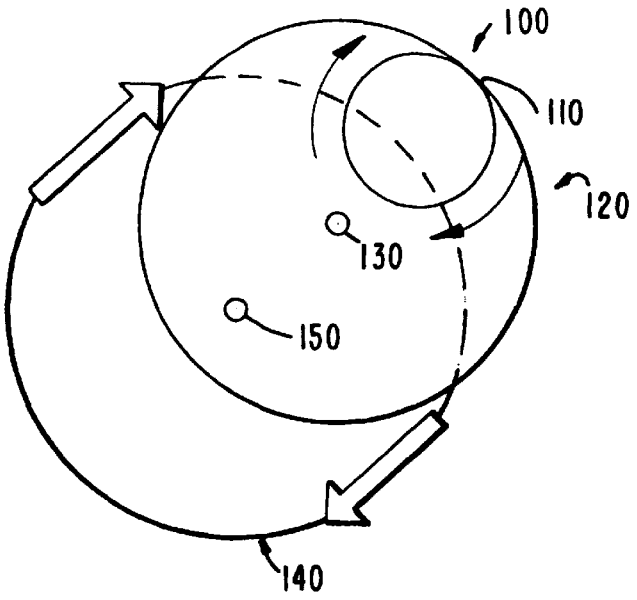
FIG. 1 is a top schematic view of the orbital motion of the dish.

As shown in FIG. 1, a dish 120 in a swing mill moves in a circular pattern around a certain virtual point 150 but does not rotate around its own center point 130. A puck 110 is free to spin or bounce within the dish, as indicated in FIG. 1. Any hard object that can move freely within the dish may be substituted for the puck. Shattering or grinding of the sample is caused by impacting the sample between the mobile puck 110 and the orbiting dish.

Figure 2:
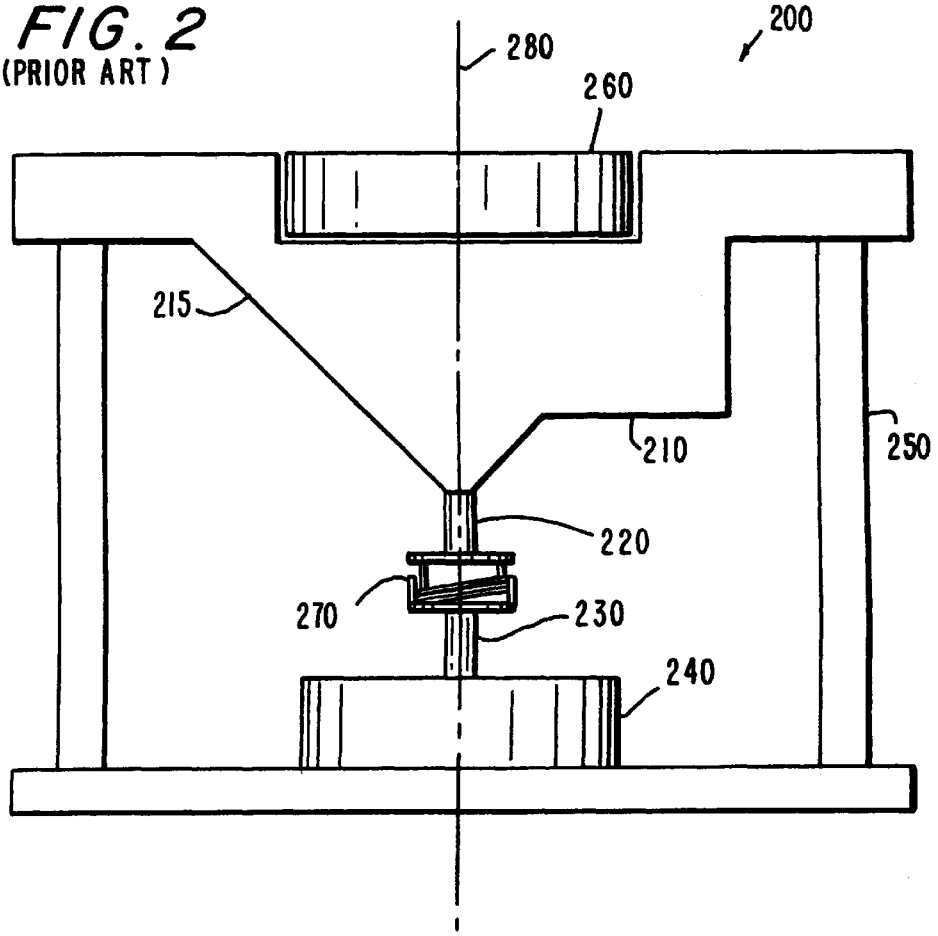
FIG. 2 (PRIOR ART)
FIG. 2 is a side plan view of a conventional swing mill.

In the SHATTERBOX®-brand swing mill referred to above, and shown in FIG. 2, the gyration of a dish holder 215, supported by flexible vertical support columns 250, and a dish 260, is caused by a circular action influenced by an off-axis weight 210 attached to dish holder 215. The SHATTERBOX® operates as follows. First, the sample and/or the puck 110 are loaded into dish 260. Dish 260 is then sealed and fixed within dish holder 215. Dish holder 215 is then gyrated about a central vertical axis 280 of the SHATTERBOX®, but not rotated, by a motor 240 via two interlocking arms 220, 230 which are joined by a flexible coupling 270. When the motor gyrates dish holder 215, weight 210 "pulls" at dish holder 215 such that dish holder 215 orbits in a tight, circular fashion on flexible support columns 250. The free movement of puck 110 against the walls of the orbiting, but not rotating, dish 260 provides grinding action.

In conventional swing mills, the apparatus is arranged in a vertical fashion (note the arrangement of the vertical support columns 250 shown in FIG. 2). In addition, conventional swing mills are typically large pieces of machinery that occupy significant laboratory space. While these systems work well, their vertical arrangement and size reduce their convenience. In addition, the mechanism used by these systems is cumbersome.

The relative motion of the puck and the dish generated in a grinding mill according to the principles of the invention is substantially the same as the motion generated in conventional swing mills. The dish (any suitable container may also be used without departing from the scope of the invention) orbits around a point other than its center point without rotating about its center point while the puck (or other suitable hard object) within the dish is free to spin and bounce against the walls of the dish, thereby grinding the sample enclosed within the dish. The difference between the grinding mill according to the invention and conventional swing mills, however, is in the apparatus and method used to produce the motion described, i.e., causing the dish to orbit around a point other than its center point without rotating about its center point while allowing the puck to freely move within the dish.

The following components may be used in a mill according to the invention: a dish, a dish holder, a spin-disk having an off-center cavity for holding the dish holder, a restrainer, a coupler, preferably comprising a pair of rollers or a line of bearings, a base and a motor. These individual parts are assembled as follows. The dish is fixedly held within the dish holder. The dish holder is movably located within the off-center circular cavity within the spin-disk. The outside of the dish holder is in at least partial contact with the spin-disk by means of a bearing which allows it to rotate inside the off--center cavity within the spin-disk. When the spin-disk is rotated about its center point, the bearings allow the dish holder to orbit within the cavity about the center point of the spin-disk.

To prevent rotation of the dish holder about its own center point, a restrainer is used. The restrainer may be constructed from a bar made from a stiff, durable material, preferably steel, a strong tension spring, or some other suitable device. The distal end of the restrainer is fixedly attached to the dish holder, and the proximal end is engaged by a pair of steel rollers or some other suitable coupler to couple the restrainer to the base. In the alternative, posts or other suitable stiff, durable projection may be used. The coupler permits the restrainer to move along its longitudinal axis but constrains it from moving along its transverse axis or angularly.

Nevertheless, the rollers do not totally restrict motion of the restrainer such that the restrainer can only move along its longitudinal axis in a piston-like fashion. Rather, there is some play or pivotability at the point of engagement between the restrainer and the rollers to allow the restrainer some axial and angular maneuverability. This pivotability allows the distal end of the restrainer, which is attached to the dish holder, to orbit with respect to the center point of the spin-disk. Creation of this orbiting motion, while restricting rotation, enables the swing mill to grind the sample without utilizing a complicated mechanism.

When the spin-disk is rotated with respect to its own center point, the dish holder orbits around the center point of the spin-disk because the cavity is off-center. The cavity must be sufficiently off-center such that, when the spin-disk is rotated about its own center point, the orbit of the dish holder about the center point of the spin-disk provides enough speed for the puck to grind within the dish. In one preferred embodiment, the invention performs well when the center point of the dish holder rotates about the center point of the spin-disk at a radial distance of approximately 7% of the inner diameter of the dish holder. The invention, however, is not limited to this distance because many factors, such as the weight of the dish, the speed generated by the motor, and the size of the dish relative to the cavity, can substantially alter the distance.

The puck is totally free to rotate, unlike the dish. The orbiting of the dish about the center point of the spin-disk without rotating about its own center point causes the puck to spin and bounce within the dish. This motion, together with the millstone-like grinding motion of the base of the puck against the floor of the dish, crushes the sample to desired fineness within the dish. The motion in the spin-disk is generated by a motor which drives the mechanism directly or via a sutiable mechanical coupling, such as a drive belt, which, in turn, rotates the spin-disk.

Figure 3:
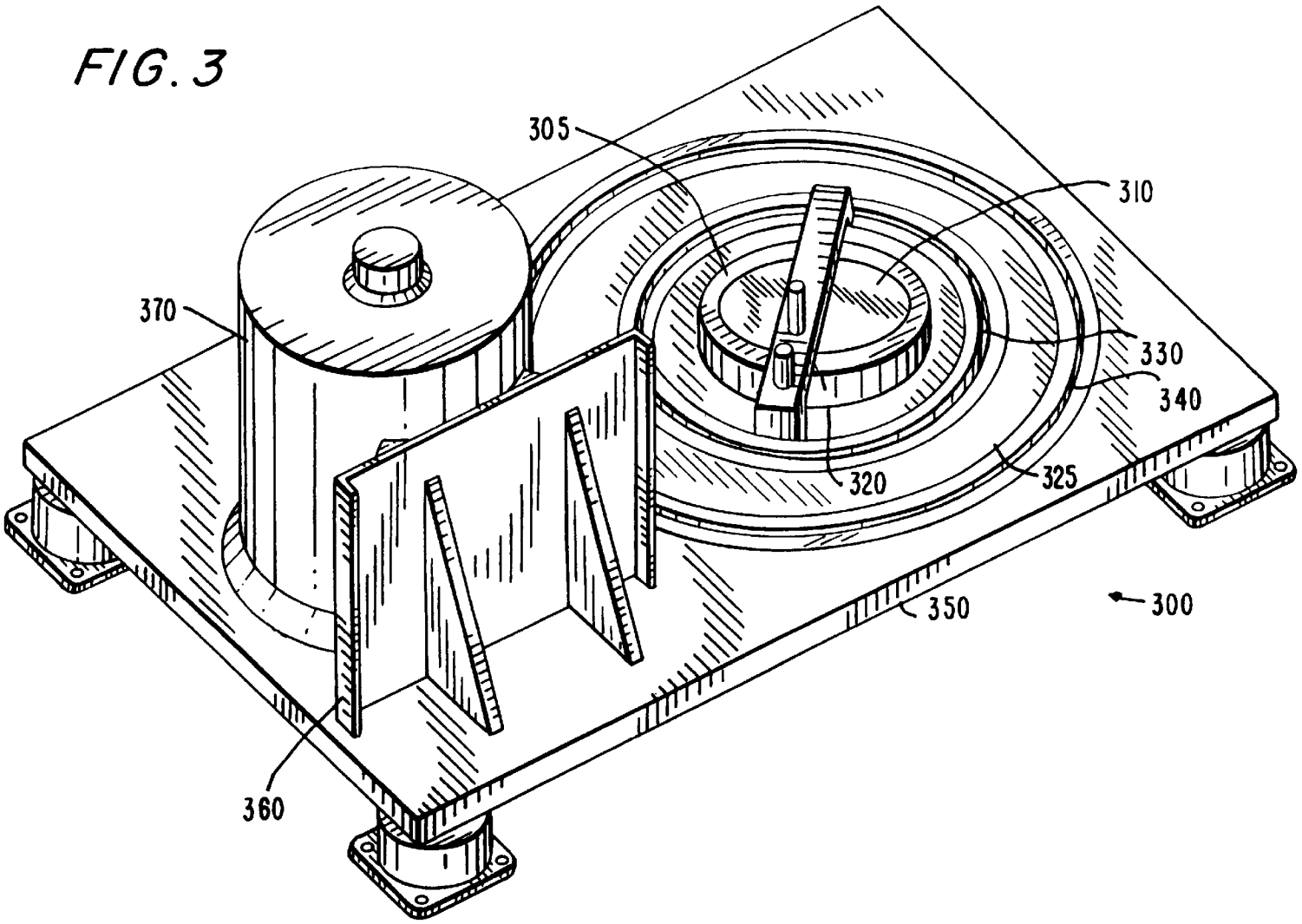
FIG. 3 is a top perspective view of a mill according to the principles of the invention.

FIG. 3 shows one embodiment of a grinding mill 300 according to the principles of the invention. A dish 305 having a top 310 is shown sealed and locked in place in a dish holder 330 by a lock-arm 320. When lock-arm 320 locks dish 305 in place, it constrains dish 305 to move with dish holder 330.

Spin-disk 340 has an off-center cavity 335 with one or more bearings (not shown) for supporting dish holder 330. The bearings allow dish holder 330 to orbit about the center point of spin-disk 340. Spin-disk 340 is preferably rotatably mounted in base 350 with bearings, but could be mounted in any suitable fashion that allows spin-disk 340 to freely rotate within base 350, e.g., on a rotatable shaft.

Figure 4:
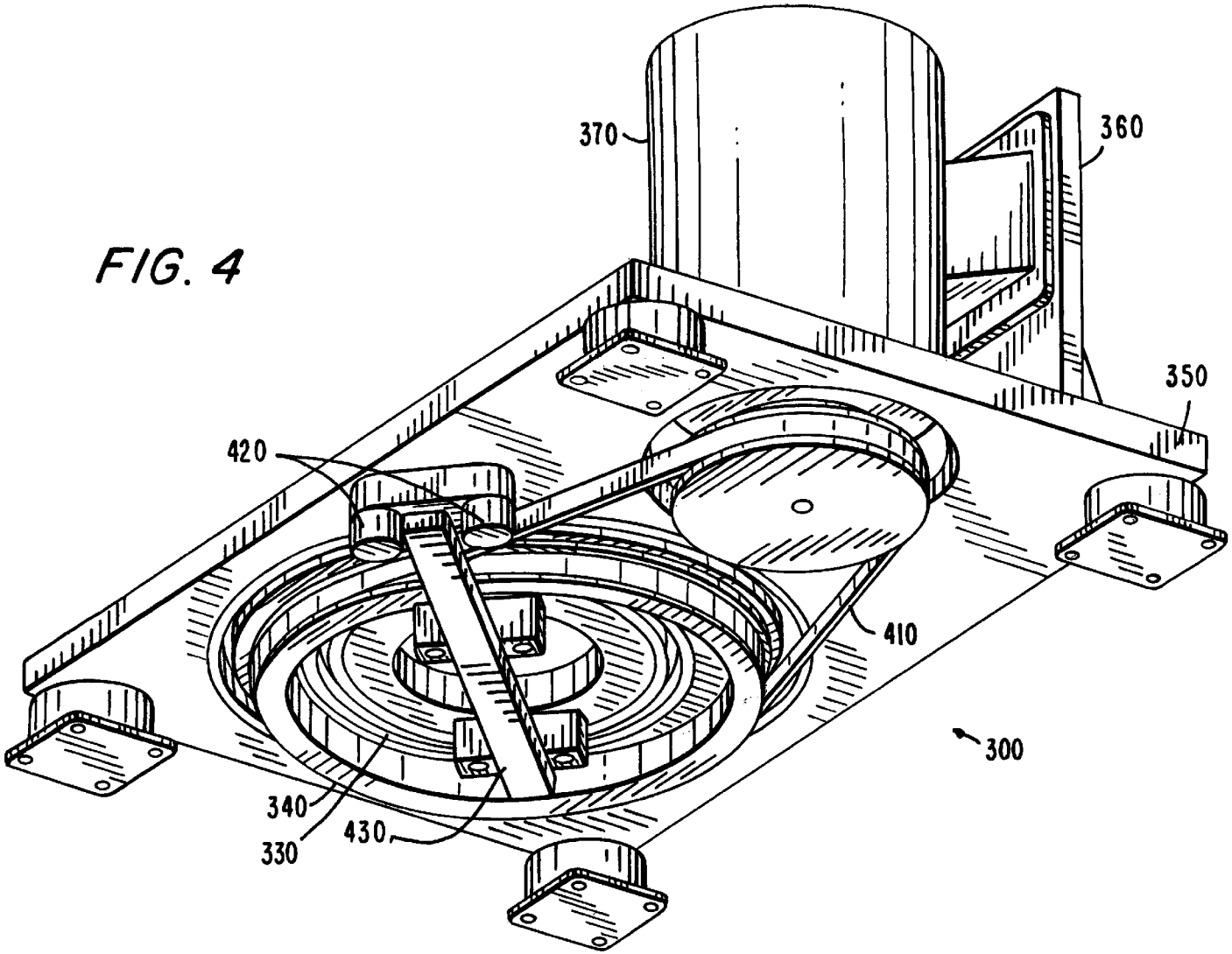
FIG. 4 is a bottom perspective view of a mill according to the principles of the invention.

FIG. 4 shows a bottom perspective view of mill 300. This view shows a motor 370 preferably mounted to a base 350. In an alternative embodiment of the invention, motor 370 could be located at some location other than on base 350. Motor 370 preferably drives a belt 410 which, in turn, preferably rotates spin-disk 340. A support brace 360 may preferably be fixedly attached to motor 370 and base 350 for stabilizing motor 370 during operation.

FIG. 4 shows restrainer 430 preferably having a proximate end engaged between rollers 420. Distally, restrainer 430 may preferably be attached to dish holder 330 at two different locations. Rollers 420 are preferably constructed from steel to withstand the force applied to them by restrainer 430 during operation of bench-top swing mill 300.

Mill 300 shown in FIGS. 3 and 4 preferably operates as follows. Motor 370 turns a shaft, which in turn drives belt 410 (in an alternative embodiment, a direct drive may be constructed between motor 370 and spin-disk 340). Belt 410 rotates spin-disk 340 within base 350. When spin-disk 340 is rotated, dish holder 330 orbits within off-center cavity 335 around the center point of spin-disk 340.

Rotation of dish holder 330 around its own center point is prevented by restrainer 430 because the proximate end of restrainer 430 is engaged between rollers 420 and the distal end of restrainer 430 is preferably attached to dish holder 330. Engagement between rollers 420 allows restrainer 430 to move along a substantially longitudinal axis, but constrains its movement along a transverse axis or angularly. This allows dish holder 330 enough motion to orbit, but not to rotate around its own center point.

Restriction of restrainer 430 from moving along a transverse axis prevents the rotation of dish holder 330 about its own center point. However, movement of restrainer 430 along a longitudinal axis, and limited movement along a transverse axis and angularly provide dish holder 330 sufficient freedom to orbit within spin-disk 340 about the center point of spin-disk 340.

The orbiting motion of dish 310 is the same as that described with reference to the orbiting motion of dish 120 shown in FIG. 1 and described above in the background section. To review for the purpose of more particularly pointing out the invention, dish holder 120 in FIG. 1 orbits in one direction around some virtual point 150. However, dish holder 120 does not rotate around its own center point 130. Puck 110 is free to move within dish 120, and the combination of the orbiting of dish 120 and the spinning and bouncing of puck 110 grinds the sample.

Similarly, in the present invention, when spin-disk 340 is rotated around its own center point within base 350, dish holder 330 orbits within spin-disk 340 around a central axis thereof, but does not rotate about its own central axis. A puck (not shown in FIGS. 3 and 4) spins and bounces (in a horizontal plane) within dish 305, thereby grinding the sample. Rotational force for the device is provided by motor 370 to spin-disk 340 via belt 410.

High rotational speeds (850 RPM in one preferred embodiment) should preferably be generated by the motor (or some other suitable device for generating rotational force) in order to properly crush the sample. The rotational speed generated by the motor depends on the size and capacity of the motor used. There are many well-known motors that are suitable in both size and performance to be used for the swing mill.

Because of the high rotational speeds generated by the motor, the motor and the spin-disk may preferably be mounted on a base, with a support brace connected between the motor and the base for stabilizing the motor during operation.

The belt between the motor and the spin-disk may be replaced with direct gear drive or some other suitable means to provide the needed rotation of the dish-holder.

In another embodiment, the entire device may preferably be encased in a carrying case for efficient transport and storage.

The material used for the dish and puck must be sufficiently hard to withstand the impact of grinding. Materials used for these components include tungsten carbide, ceramic, agate and hardened chrome steel. However, other suitable materials are also possible, and their use does not depart from the scope of the invention.

Finally, a lock-arm that must be sufficiently strong, yet able to be opened and shut quickly enough for repeated use, is required. Such lock-arms are known in the art, and can easily be obtained or constructed without undue experimentation.

Thus it is seen that a grinding mill has been provided. The same motion illustrated with regard to the grinding mill can be used in other mills without departing from the spirit of the invention. One skilled in the art will appreciate that the present invention can be practiced by other than the described embodiments, which are presented for purposes of illustration rather than of limitation, and the present invention is limited only by the claims which follow.

What is claimed is:

1. A grinding mill comprising:

at least one dish for holding a sample of a material to be ground;

a dish holder for fixedly holding said dish;

a base;

a spin-disk rotatably mounted in said base, said spin-disk having an off-center cavity for rotatably engaging said dish holder and a central axis, and wherein when said spin-disk is rotated about said central axis, said dish holder orbits within said cavity about said central axis;

a restrainer for restraining said dish holder from rotating as it orbits around said central axis of said spin-disk, and wherein said restrainer includes a distal end attached to said dish and a proximate end;

a coupler mounted on said base for movably engaging said proximate end, said coupler for restraining the movement of said restrainer;

a puck disposed within said dish for grinding a sample, wherein said puck is substantially free to move within said dish; and a motor connected to said spin-disk, said motor for rotating said spin-disk.

2. The grinding mill of claim 1, wherein said motor is connected to said spin-disk by a belt.

3. The grinding mill of claim 1, wherein said motor is connected to said spin-disk by a direct drive gear system.

4. The grinding mill of claim 1, wherein said coupler comprises a pair of steel rollers.

5. The grinding mill of claim 1, wherein said motor is mounted on said base.

6. The grinding mill of claim 1, wherein said dish holder is movably engaged by at least one bearing mounted within said spin-disk.

7. The grinding mill of claim 1, further comprising;

a top; and a lock-arm mounted on said dish holder for fixedly securing said dish to said dish holder and for fixedly securing said top over said dish wherein said dish is covered by said top.

8. The grinding mill of claim 1, further comprising a ring disposed within said dish for grinding a sample, wherein said ring is substantially free to move within said dish wherein said ring is used together with said puck.

9. A method for grinding a sample using orbital motion, in a grinding mill having a base, at least one dish, a dish holder, a spin-disk rotatably mounted in said base, said spin-disk having a spin-disk center point and an off-center cavity, said dish holder being rotatably mounted in said cavity, and a distal end attached to said base, and a puck, said method comprising:

loading a sample and said puck into said dish;

mounting said dish in said dish holder;

rotating said spin-disk; and restraining said dish holder within said spin-disk so that said dish holder can orbit with respect to said spin-disk center point, but not rotate about said dish holder center point, thereby causing said puck to bounce and spin within said dish.

10. The method of claim 9, wherein said restraining further comprises restraining with a restrainer having a proximate end movably attached to said base and a distal end attached to said dish holder.

11. The method of claim 10, wherein said restraining further comprises movably attaching said proximate end to said base with a coupler.

12. A grinding mill comprising:

at least one dish for holding a sample of a material to be ground;

a dish holder for fixedly holding said dish;

a base;

a spin-disk rotatably mounted in said base, said spin-disk having an off-center cavity for rotatably engaging said dish holder and a central axis, and wherein when said spin-disk is rotated about said central axis, said dish holder orbits within said cavity about said central axis;

a restrainer for restraining said dish holder from rotating as it orbits around said central axis of said spin-disk, and wherein said restrainer includes a distal end attached to said dish and a proximate end;

a coupler mounted on said base for movably engaging said proximate end, said coupler for restraining the movement of said restrainer;

a ring disposed within said dish for grinding a sample, wherein said ring is substantially free to move within said dish; and a motor connected to said spin-disk, said motor for rotating said spin-disk.

* * * * *